United States Patent [19]

Scott

[11] 3,973,546

[45] Aug. 10, 1976

[54] STARTER SAFETY DEVICE

[76] Inventor: Forrest C. Scott, 220 S. East Ave., Baltimore, Md. 21224

[22] Filed: Aug. 2, 1974

[21] Appl. No.: 494,307

[52] U.S. Cl. ..... 123/179 A; 123/179 B; 123/198 D; 290/DIG. 7

[51] Int. Cl.[2] ..... F02N 17/00

[58] Field of Search..... 123/179 B, 179 BG, 198 D, 123/198 DC, 148, 179 A; 290/DIG. 7

[56] References Cited

UNITED STATES PATENTS

| | | | |
|---|---|---|---|
| 1,603,766 | 10/1926 | Hajek | 290/DIG. 7 |
| 1,792,583 | 2/1931 | Good | 123/179 B |
| 1,908,088 | 5/1933 | Warner | 290/DIG. 7 |
| 2,210,044 | 8/1940 | Schirokaver | 123/179 B |
| 2,504,670 | 4/1950 | Everest | 123/179 B |
| 2,537,354 | 1/1951 | Korte et al. | 123/179 B |
| 2,581,737 | 1/1952 | West | 123/179 BG |
| 2,768,708 | 10/1956 | Cooper | 123/179 B |
| 2,771,068 | 11/1956 | Jettinghoff | 123/179 B |
| 2,949,906 | 8/1960 | Voigt | 123/179 B |
| 3,046,964 | 7/1962 | Chery | 123/179 B |
| 3,116,729 | 1/1964 | Crowe | 123/179 B |
| 3,421,489 | 1/1969 | Rhoads | 123/179 BG |

FOREIGN PATENTS OR APPLICATIONS

| | | | |
|---|---|---|---|
| 423,007 | 12/1947 | Italy | 290/DIG. 7 |

*Primary Examiner*—Charles J. Myhre
*Assistant Examiner*—James D. Liles
*Attorney, Agent, or Firm*—J. Wesley Everett

[57] ABSTRACT

An electric safety switch assembly for an internal combustion engine, the engine being provided with an oil pump to supply oil to a oil line for lubricating the engine, and an electric operated starter for the engine, including a manually operatable starter switch or closing an electric circuit to the starter and an electric circuit-breaker in the form of a oil pressure switch positioned between the manually operated switch and the starter which is normally held closed when there is no oil pressure in the oil line. The pressure switch is adapted to open the electric circuit when the engine is rotated sufficiently to cause the oil pump to produce a predetermined pressure in the oil line.

2 Claims, 4 Drawing Figures

STARTER SAFETY DEVICE

The present invention relates to an electric safety assembly for internal combustion engine wherein the engine is equipped with a pressure oil pump for supplying oil pressure to an oil line for lubricating the engine and an electric-operated starter motor and an electric circuit for operating the engine starter motor.

The primary object of the engine is to provide means wherein the electrically operated engine starter motor will be operatable as long as there is no oil pressure in the oil line.

A further object of the invention is to provide means for allowing the starter motor to rotate the engine until oil pressure has been built up in the line in a predetermined amount wherein the pressure switch will automatically break the electric circuit to the starter motor.

Another object of the invention is to provide means to prevent the starter from being over-heated by long periods of operation.

Still another object of the invention is to provide means to prevent the starter from being operated while the engine is running and producing oil pressure in the oil line.

While several objects of the invention have been set forth, other objects, uses and advantages will become more apparent as the nature of the invention is more fully disclosed in the following description with reference to the accompanying drawings.

In referring to the drawings, like and similar characters are used to point out like and similar parts throughout the several views.

Figure 1:
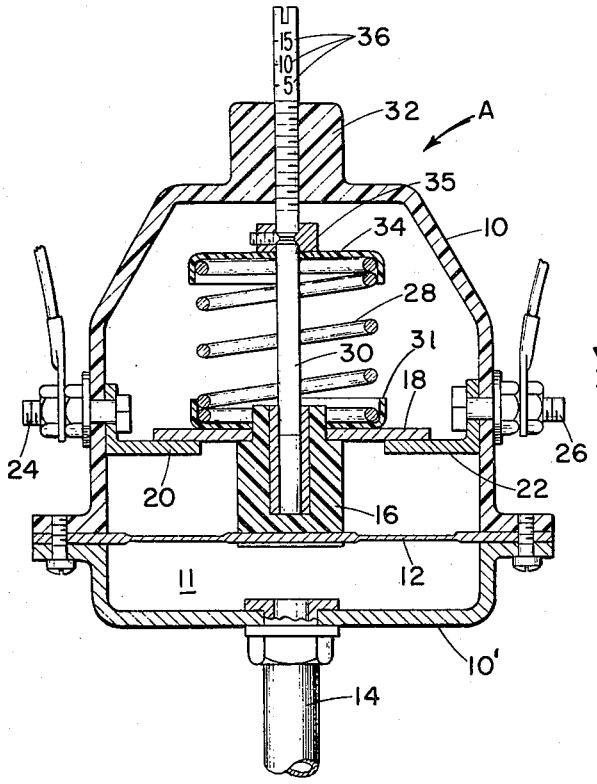
FIG. 1 is a sectional view of an oil pressure operated electric switch in which the contact elements are shown in closed position.

With reference to the drawings, there is provided an oil pressure electric switch A, comprising a housing having an upper portion 10 and a lower portion 10' made preferably of a plastic or some kind of non-conducting material. Between the members 10 and 10' of the housing there is secured a diaphragm 12. Below the diaphragm and the outer end of the housing 10' is a space 11 for receiving oil from an oil pipe line 14. Associated with the upper surface of the diaphragm and extending upwardly is a member 16, preferably of an insulated material, for supporting a metal washer 18 which is a conductor of electrical current. This washer is adapted to rest on the electric contact members 20 and 22 which are connected to terminals 24 and 26. The washer 18 is held in contact with the contact member 20 and 22 by the compression spring 28, which in turn is held in position by a shaft 30. The shaft 30 is threadably receivable into and through a member 32 and is adjustable perpendicular to the plane of the diaphragm. The inner end of the spring is cradled in a disc member 31 fixed to the member 16 and above the plate 18, and the outer end of the spring is receivable within a disc 34 which is movable with the shaft for regulating the pressure on the spring in order to regulate the spring tension on the diaphragm to adjust the amount of oil pressure required to lift the diaphragm and the washer 18 off the contact member 20 and 22. The amount of pressure applied to the spring may be indicated on the outer end of the shaft 30 as shown at 36.

Figure 2:
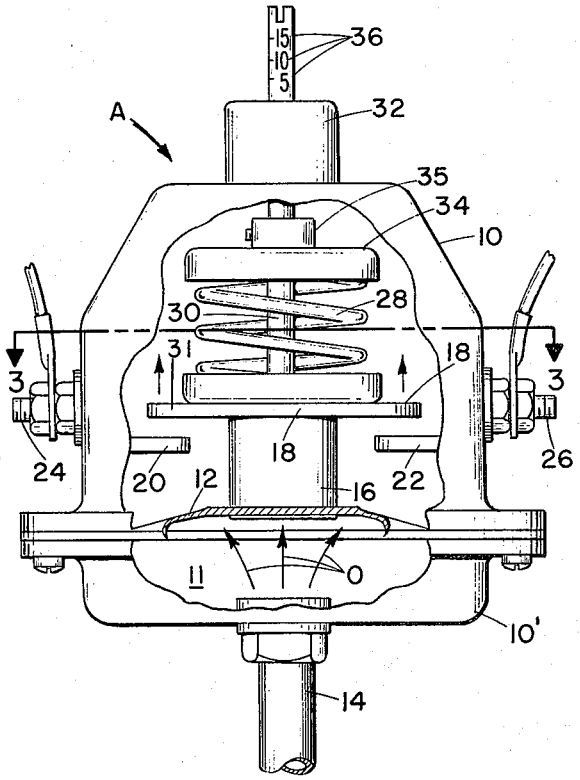
FIG. 2 is a view similar to FIG. 1 of the oil pressure switch shown partly in elevation and partly in section in which the contact elements are shown in open position.
Figure 3:
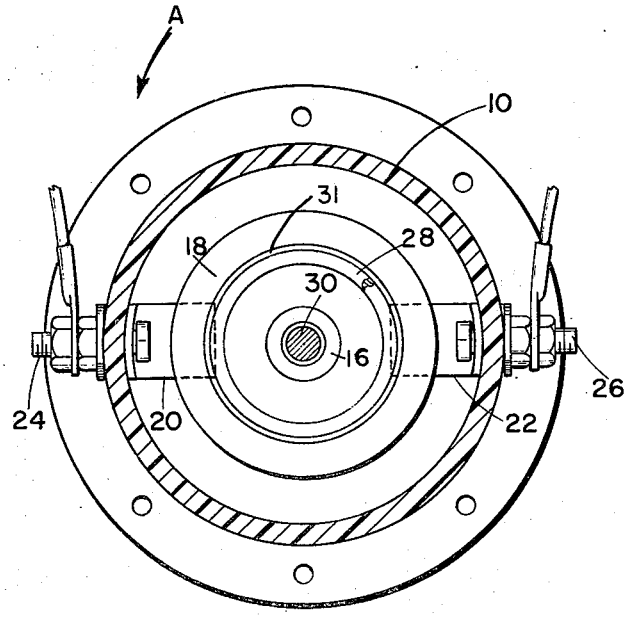
FIG. 3 is a sectional view taken on line 3—3 of FIG. 2.

FIG. 2 shows the same structure as shown in FIG. 1 in which the diaphragm has been moved upwardly by the oil pressure 11, against the spring 28 which also moves the washer out of contact with the members 20 and 22.

Figure 4:
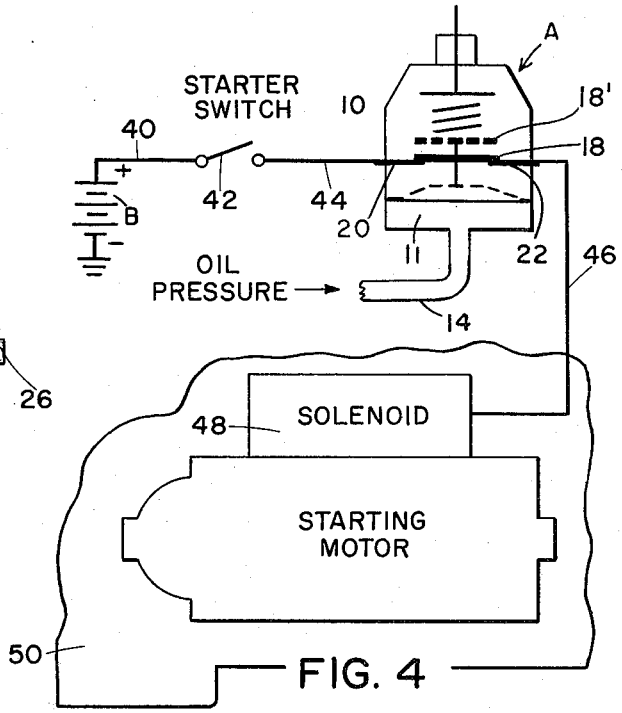
FIG. 4 is a schematic view showing the oil pressure switch contact elements in closed position and a wiring diagram of the electric circuit.

FIG. 4 shows the manner in which the electric current is supplied to the solenoid 48 associated with the starter motor. The electric current is supplied by a battery B having one terminal grounded to the engine and to which one side of the starter circuit is also grounded. Attached to the other battery terminal is a wire 40 leading to a manually operated switch 42. When the switch 42 is closed electric current will flow through the wire 44, the washer 18 of the oil pressure switch A when the washer is in contact with the terminals 20 and 22 as shown in FIG. 4. Current will then flow through wire 46 to the solenoid 48 to rotate the engine 50.

It is assumed the engine is provided with an oil pump for supplying oil under pressure through an oil line to the various parts of the engine, the oil line being connected to the pipe 14 of the pressure control switch.

As the engine is rotated by the starter motor, oil pressure O will begin to build up in the oil line which will flow into the chamber 11 through the pipe 14 and act upon the diaphragm 12 raising the diaphragm and washer member 18 out of contact with the contact member 20 and 22, as shown at 18' in FIG. 4, breaking the electric circuit to the starter motor. This arrangement prevents the long use of the starter. Regardless of whether or not the engine starts, oil pressure will build up in the oil line by rotating the engine, therefore, the starter will be cut out by the pressure switch A after several minutes of operation and until the oil pressure has built up to a predetermined point which may be determined by rotating the shaft 30.

This arrangement also prevents the starter motor from operating at any time while the engine is running and supplying oil under pressure to the oil line.

There are certain types of apparatus, such as material moving equipment, wherein the operator is remotely located from the engine and out of hearing of its operation and he may throw the starter switch causing the starter to engage the running engine, many times damaging the starter and sometimes the engine itself.

The present assembly makes it impossible to start the engine as long as there is pressure in the oil line.

While a specific structure has been shown and described in detail, it is not intended that the invention be limited to these particular means.

What is claimed is:

1. In combination with an internal combustion engine, including an electrically operated starter motor having a pressurized oil lubricating system and an oil pump for creating said oil pressure, an electric storage battery having a positive terminal and a negative terminal, a two pole manually operated electrical switch, means for connecting a first pole of the manually operated switch to the positive terminal of the storage battery and means for connecting the negative pole of the storage battery to a ground, a second pole of the manually operated switch having means for connecting the same to a two pole pressure operatable switch and means for connecting the second pole of the pressure operatable switch to the starter motor, said pressure switch having a housing of two compartments, one of said compartments being hermetically sealed about its peripheral edge having a single oil inlet therein, a diaphragm extending between the two compartments and sealed thereto, an insulation spacer having a first end positioned on the diaphragm and a second end extending into the second compartment, having a first electric contact element secured to the second end of the insulation spacer, a second pair of electric contact members oppositely disposed on said second compartment housing positioned to engage the first electric contact member and means extending through the said second compartment housing for attaching the second pair of electric contact members thereto, one of said attaching means being connected to one of the poles of the manually operated switch, and the other pole of the pressure switch being connected to the starter motor, a post fixed to the second compartment housing substantially perpendicular to the diaphragm, the inner end of which is slideably engagable with a hole formed in the second end of the insulation member, a compression spring having its outer end fixed to the outer end portion of the post, the opposite end of the spring adapted to bear against the first electrical contact element for holding the same in contact with the second pair of contact members whereby the first contact element will be moved out of engagement with the second contact members when the diaphragm is flexed by the pressure of the oil in the first compartment reaching a predetermined pressure.

2. A device as claimed in claim 1 wherein the post carried by the second compartment housing having means associated therewith for adjusting the post relative to the diaphragm.

* * * * *